United States Patent [19]

Willumsen

[11] Patent Number: 5,056,253

[45] Date of Patent: Oct. 15, 1991

[54] HANDGUN STABILIZING STRAP

[76] Inventor: Phillip L. Willumsen, 2730 Valley View Dr., Missoula, Mont. 59803

[21] Appl. No.: 555,602

[22] Filed: Jul. 23, 1990

[51] Int. Cl.[5] ..... F41C 27/22

[52] U.S. Cl. ..... 42/94

[58] Field of Search ..... 42/71.02, 72, 85, 90, 42/94, 100; 224/150, 151

[56] References Cited

U.S. PATENT DOCUMENTS

| | | | |
|---|---|---|---|
| 1,177,748 | 4/1916 | Webster | 42/94 |
| 2,985,980 | 5/1961 | Broshous | 42/94 |
| 3,553,878 | 1/1971 | Canon | 42/94 |
| 4,515,301 | 5/1985 | A'Costa | 42/94 |

*Primary Examiner*—Charles T. Jordan

*Attorney, Agent, or Firm*—Fleit, Jacobson, Cohn, Price, Holman & Stern

[57] ABSTRACT

A handgun stabilizing strap in the form of an elongated, flexible, inelastic webbing strap having an adjustable neck encircling loop at one end and a thumb engaging loop at the other end with the thumb engaging loop engaged with the thumb of the strong or shooting hand of the individual aiming and shooting the gun. The larger neck encircling loop is placed around the shooters neck and the small loop at the other end of the strap is placed around the thumb of the handgun shooter's shooting hand to stabilize the handgun while it is being aimed and while the trigger is being pulled when shooting the gun.

4 Claims, 1 Drawing Sheet

HANDGUN STABILIZING STRAP

BACKGROUND OF THE INVENTION

1. Field of the Invention

The present invention generally relates to a device for stabilizing a handgun when aiming and shooting the gun. More specifically, the invention is a handgun stabilizing strap in the form of an elongated, flexible, inelastic webbing strap having an adjustable neck encircling loop at one end and a thumb engaging loop at the other end with the thumb engaging loop engaged with the thumb of the strong or shooting hand of the individual aiming and shooting the gun. The larger neck encircling loop is placed around the shooters neck and the small loop at the other end of the strap is placed around the thumb of the handgun shooter's shooting hand to stabilize the handgun while it is being aimed and while the trigger is being pulled when shooting the gun.

2. Description of the Prior Art

Various devices have been provided to assist individuals when aiming and shooting handguns. The following U.S. patents disclose devices of this general type.

2,812,123
3,553,878
4,361,258
4,515,301
4,843,749
2,985,980

The above patents disclose rigid brace devices and various types of gun slings and the like. U.S. Pat. No. 2,985,980 discloses a stabilizing strap which goes around the neck of a shooter and includes a ring at the opposite end which engages the handgun or weak hand rather than being engaged with the thumb of the strong hand of the shooter. This invention provides significant advantages over the prior art in which the prior art engages either the gun or the weak hand of the shooter. In addition, the strap of this invention can be used to stabilize other devices in which added stability is desirable when aiming or sighting such devices.

SUMMARY OF THE INVENTION

An object of the present invention is to provide a stabilizing strap for use by a shooter when aiming and shooting a handgun with the strap including an adjustable neck encircling loop at one end and a permanently formed smaller thumb engaging loop at the other end with the thumb loop engaged over the thumb on the shooting or strong hand of the shooter.

Another object of the invention is to provide a stabilizing strap in accordance with the preceding object in which the thumb loop is formed by stitching the end of the strap to itself in spaced relation to the end to form a small loop with the portion of the loop engaging the thumb being folded and stitched longitudinally to provide a thumb loop that is ½ the width of the remainder of the strap.

A further object of the invention is to provide a handgun stabilizing strap in accordance with the preceding objects in which the neck encircling loop is adjusted in relation to the remainder of the strap by a slip buckle which receives both the main portion of the strap and the free end portion of the strap adjustably therethrough to enable the diameter of the neck encircling loop to be adjusted and to enable the overall length of the strap to be adjusted by varying the position of the neck encircling loop in relation to the free end of the strap.

Still another object of the invention is to provide a stabilizing strap which can be utilized in combination with a plurality of sighting devices such as hand-held survey transit levels, telescopes, cameras with telephoto lenses, high-power monoculars or spotting scopes, or any other arrangement where added stability is desired inasmuch as the strap will reduce sighting wobble or movement when sighting a handgun or other similar units.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
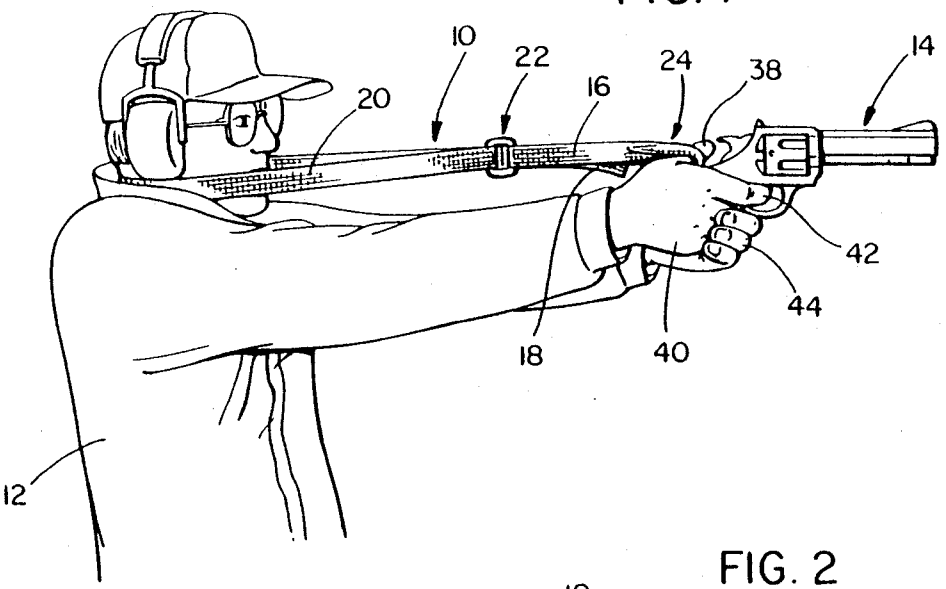
FIG. 1 is an elevational view of the handgun stabilizing strap of the present invention being used by a shooter.

Referring now specifically to the drawings, the handgun stabilizing strap of the present invention is generally designated by a reference numeral 10 and is used by an individual 12 when aiming and shooting a handgun generally designated by reference numeral 14 which in FIG. 1 is in the form of a revolver. However, the stabilizing strap 10 can be used with various types of handguns including single shot pistols, semi-automatic pistols and the like. The strap 10 includes a flexible strap 16 constructed of an inelastic webbing material such as polypropylene. The strap 16 includes a free end 18 with a neck encircling loop 20 being formed in the strap by a slip buckle generally designated by reference numeral 22 with a thumb loop generally designated by the numeral 24 at the opposite end of the strap 16.

Figure 2:
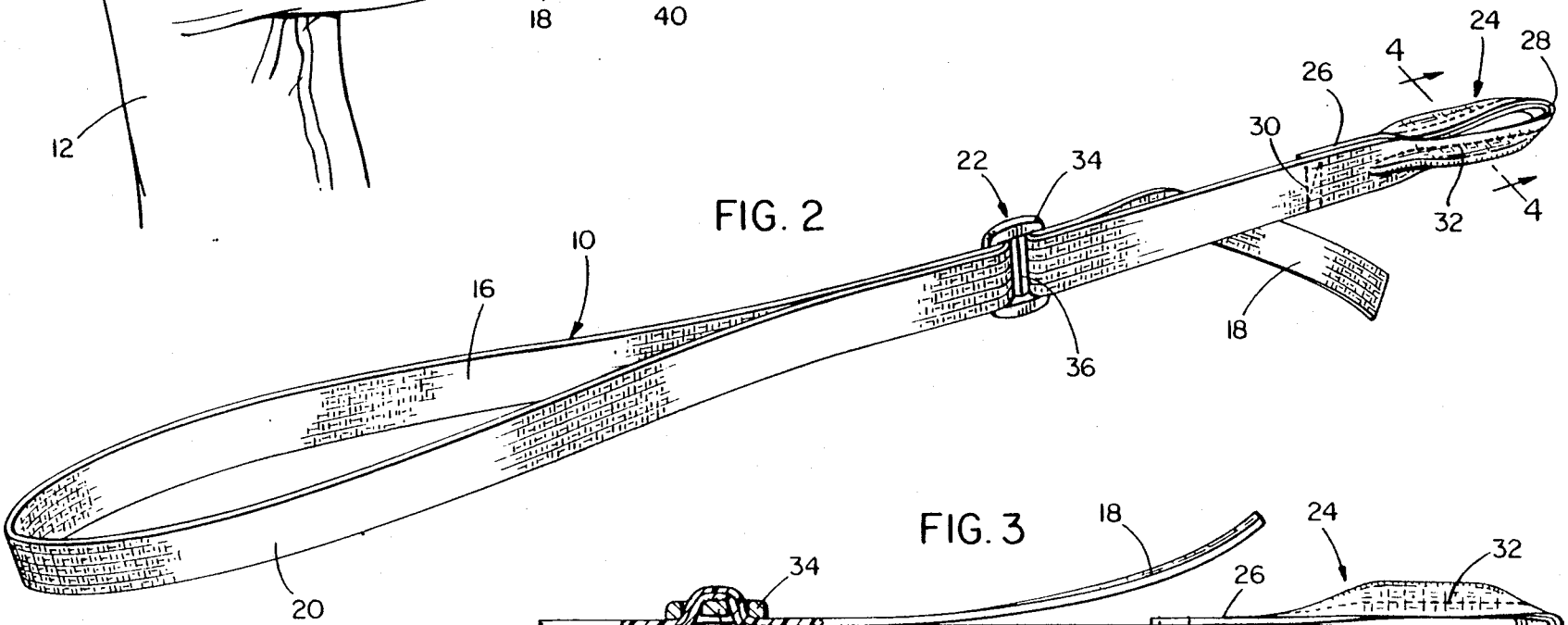
FIG. 2 is a prospective view of the stabilizing strap.
Figure 3:
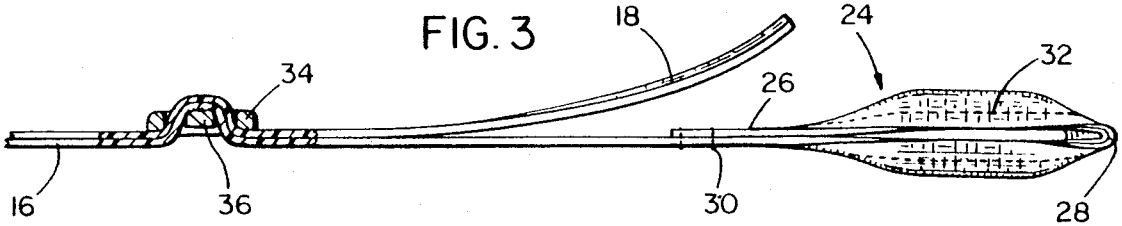
FIG. 3 is a fragmental, enlarged view of the thumb loop and slip buckle structure.
Figure 4:
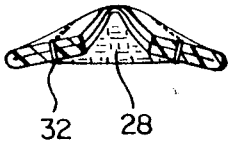
FIG. 4 is a transverse, sectional view taken substantially along section line 4—4 on FIG. 2 illustrating further specific structural details of the thumb engaging loop.

The thumb loop 24 is formed by reversely folding an end portion 26 of the strap about a fold line 28 with the end portion 26 of the strip being stitched to the strap 16 as at 30 with the stitching 30 being an overlap stitch arrangement approximately ½" in length. The portion of the strap 16 outwardly of the stitching 30 is folded about a central longitudinal axis and longitudinally stitched as at 32 adjacent the overlapping edges to form a loop 24 that is ½ the width of the strap with the longitudinally folded arrangement of the loop 24 being best illustrated in FIG. 4 so that each side of the loop includes the folded over strap secured by the stitching 32. The width of the strap is preferably 1" and the slip buckle 22 is a 1" buckle and includes a rectangular frame 34 having a centrally disposed transverse member 36 rigid with the ends of the buckle as illustrated in FIGS. 2 and 3 with both the strap 16 and the free end 18 of the strap 16 extending through the spaced slots between the sides of the frame 34 and the transverse member 36 and being frictionally held in adjusted position in a well known manner.

When using the device, the strap 16 and buckle 22 are associated in the manner illustrated and the size and position of the neck engaging loop 20 is adjustable by adjusting the strap components in relation to the buckle 22. This enables the thumb engaging loop 24 to be accurately adjusted and stabilized so that it can be positioned over the thumb 38 on the strong or shooting hand 40 of the shooter 12 with the hand 40 including a finger 42 which engages the trigger of the handgun 14 in order to shoot the gun. The neck engaging loop 20 extends around and engages the rear surface of the neck of the shooter or individual 12 with the inelastic strap 16 providing stability to the hands 40 and 44 of the shooter when the gun 14 is being aimed and shot. While dimensions can vary, an overall length of the strap of 58" has been found to suffice in most instances. The length of the stitching 32 may be approximately 2" to provide a thumb loop having a width of approximately ½". The webbing material from which the strap is constructed may be 1/32" in thickness and the slip buckle 22 enables adjustment of the overall length of the strap 10 when it is assembled in relation to the shooter and the handgun and also provides adjustment of the size of the neck loop so that the strap can be used by several shooters or by the same shooter in several different stances or positions.

The strap of this invention provides a substantial increase in stability of the handgun being operated by the shooter and provides an increase in accuracy of handgun shooting due to the stability of the handgun when using the strap. The use of the strap also materially reduces sighting wobble or movement when the handgun is being sighted or aimed. Further, the strap provides more rapid sight recovery on recoil thereby introducing rapid sight acquisition for faster and more accurate second shot or multiple shot delivery. Thus, by using the strap, overall shooting confidence is enhanced by the increase in accuracy and the increase in effective accurate range of the handgun. The thumb loop is a fixed, non-adjustable loop and is not affixed to the gun in any way whatsoever. The thumb loop operates on the "strong" or shooting hand rather than being affixed to the gun or engaging the "weak" hand. The slip buckle structure provides quick and extremely accurate adjustment for relating the strap to the user's position, size and instrument with which the strap is used since the strap can be used to stabilize various sighting devices such as hand-held survey instruments, telescopes, telephoto camera lenses, monoculars or similar units where additional stability is desirable and will enhance the sighting characteristics of such units.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A stabilizing strap for a sighting instrument comprising an elongated, flexible, inelastic strap, said strap including a neck engaging loop at one end thereof and a thumb engaging loop at the other with the thumb engaging loop engaging the thumb of the strong hand of a person holding and sighting the instrument, said strap including a buckle structure adjustably receiving a free end of the strap to form the neck engaging loop, said buckle structure being a slip buckle enabling the size of the neck engaging loop to be varied and enabling the overall length of the strap to be adjusted to fit different positions of a user and users of different size, said thumb engaging loop including a reversely folded end portion of the strap with the end of the reversely folded strap being stitched to the strap to form a permanent loop, said thumb loop having a major portion of its length folded along a longitudinal center line and stitched in parallel relation to the overlapping edges of the fold along the longitudinal center line thereby forming a thumb loop having a width substantially ½ of the width of the strap.

2. A handgun stabilizing strap used by a shooter holding a handgun with the strong hand of the shooter operating the handgun, said strap comprising an elongated flexible, inelastic member having a neck engaging loop at one end and a strong hand thumb engaging loop and receiving the free end of the strap to adjust the size of the neck engaging loop and the distance between the neck engaging loop and the thumb engaging loop to enable to strap to be utilized with various gun positions and with various shooters, said thumb engaging loop being formed by a reversely folded, stitched end portion of the strap, said thumb engaging loop being folded longitudinally along a center line and stitched to form a loop of a width substantially ½ the width of the strap thereby forming a relatively narrow thumb engaging loop to engage the thumb while leaving the tip of the thumb free to move when aiming and shooting the gun.

3. In combination, a handgun having a handgrip, an operating trigger and sighting structure, said handgun being gripped by the strong hand of a shooter with the forefinger on the strong hand engaging with and operating the trigger, and a single stabilizing strap for the handgun, said stabilizing strap including an elongated, flexible, inelastic strap, means forming a neck encircling loop at one end of the strap and a thumb engaging loop at the other end of the strap, said strap being completely separate from and free of the handgun with the thumb engaging loop engaging the thumb of the strong hand which operates the trigger of the handgun to stabilize the handgun by tensioning the strap when aiming and shooting the gun with the strap tension being applied to the strong hand at only a single point whereby the handgun is held and stabilized solely by the shooter and the tension force exerted on the strap by the thumb on the strong hand of the shooter which is engaged with an upper portion of the handgrip.

4. The combination as defined in claim 3 wherein said thumb engaging loop is of unitary construction with the strap and has a width substantially less than the width of the strap to engage a minor portion of the length of the thumb to enable the tip of the thumb on the strong hand to be utilized in gripping and operating the handgun, said neck encircling loop being integral with the strap and being formed by a reversely folded end portion of the strap, buckle means securing the end portion of the strap adjustably to the portion of the strap extending between the thumb loop and the neck encircling loop to vary the effective length of the stabilizing strap for use of the strap by shooters having different arm lengths.

* * * * *